United States Patent [19]

Linder et al.

[11] 4,130,098

[45] Dec. 19, 1978

[54] METHOD AND APPARATUS FOR REDUCING THE TOXIC COMPONENTS IN EXHAUST GAS

[75] Inventors: Ernst Linder, Mühlacker; Günter Wössner, Esslingen; Helmut Maurer, Schwieberdingen; Franz Rieger, Wasseralfingen, all of Germany

[73] Assignee: Robert Bosch GmbH, Stuttgart, Germany

[21] Appl. No.: 821,425

[22] Filed: Aug. 3, 1977

Related U.S. Application Data

[62] Division of Ser. No. 560,555, Mar. 20, 1975, Pat. No. 4,075,992.

[30] Foreign Application Priority Data

Mar. 27, 1974 [DE] Fed. Rep. of Germany ..... 2414761

[51] Int. Cl.[2] ..... F02M 25/06

[52] U.S. Cl. ..... 123/119 A; 123/198 R; 340/59

[58] Field of Search ..... 123/119 A, 198 R, 198 D; 340/59, 60

[56] References Cited

U.S. PATENT DOCUMENTS

| | | | |
|---|---|---|---|
| 3,779,222 | 12/1973 | Lorenz | 123/119 A |
| 3,794,006 | 2/1974 | Woodward | 123/119 A |
| 3,850,151 | 11/1974 | Mawatari et al. | 123/119 A |
| 3,851,632 | 12/1974 | Teshirogi et al. | 123/119 A |
| 3,924,587 | 12/1975 | Murphy | 123/119 A |
| 3,937,194 | 2/1976 | Tamaki et al. | 123/119 A |
| 3,963,011 | 6/1976 | Saito | 123/119 A |
| 4,004,559 | 1/1977 | Itoh | 123/119 A |
| 4,044,734 | 8/1977 | Lewis | 123/119 A |
| 4,071,003 | 1/1978 | Aono | 123/119 A |

*Primary Examiner*—Wendell E. Burns
*Attorney, Agent, or Firm*—Edwin E. Greigg

[57] ABSTRACT

A portion of the exhaust gas of an internal combustion engine is returned to the induction manifold through an exhaust gas recycling line. This recycle line contains one or more orifice plates to create a measurable pressure drop when gas is flowing. The gas flow through the recycle line may be interrupted in controlled manner by a valve, particularly a magnetically actuated valve. The pressure drop across the orifice plate or plates is sensed by pressure-responsive electrical switches which provide input signals for a logical circuit that energizes a signaling device to warn the operator of a malfunction in the exhaust gas recycling system.

8 Claims, 6 Drawing Figures

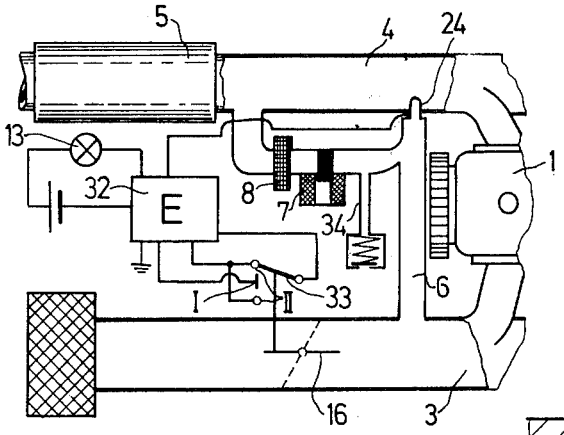
Fig. 4
Fig. 5
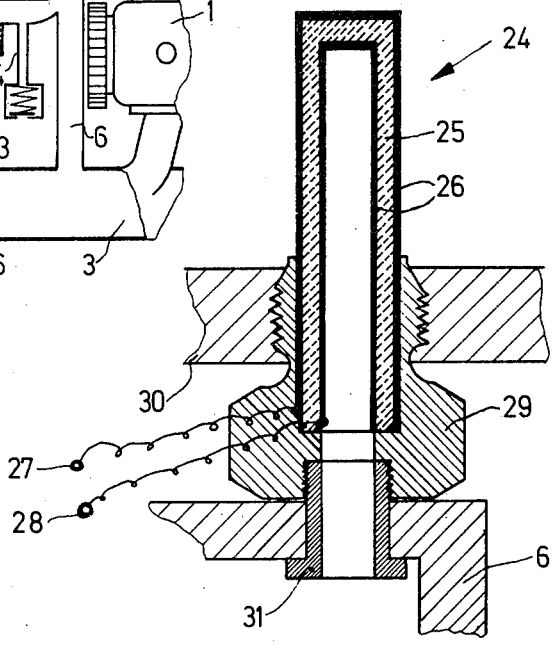
Fig. 6
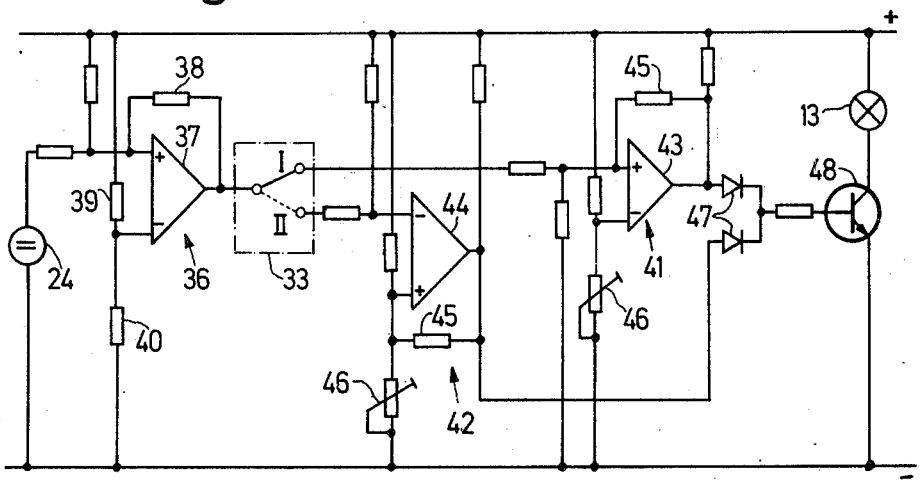

METHOD AND APPARATUS FOR REDUCING THE TOXIC COMPONENTS IN EXHAUST GAS

This is a division of application Ser. No. 560,555, filed Mar. 20, 1975, now U.S. Pat. No. 4,075,992.

BACKGROUND OF THE INVENTION

The present invention relates to a method of reducing the toxic components, more particularly nitrogen oxides, in the exhaust gas of internal combustion engines by returning a part of the exhaust gas to the intake side of the engine by means of an exhaust gas recycle line or conduit which is adapted to be controlled by a valve.

The recycling of exhaust gas is intended primarily to reduce the toxic $NO_x$ content when the engine is operating on partial load. 2–20% of exhaust gas relative to the quantity of fresh air drawn in by the engine is recycled. The valve controlling the exhaust gas recycle line is actuated as a function either of the underpressure in the induction tube or of the position of the throttle valve.

OBJECT AND SUMMARY OF THE INVENTION

It is the principal object of the present invention to monitor the operation of the exhaust gas recycling system. It is another object of the invention to check for breaks in the exhaust gas recycle line. Yet another object of the invention is to warn the operator of a malfunction in the exhaust gas recycling system. If such a break were to occur, the drive performance of the engine would be adversely affected only during idling and at lower speeds; at other times the performance tends to improve rather than deteriorate when the exhaust gas recycling system fails.

These objects are achieved, according to the invention, in that the recycled exhaust gas flow is used as the command or reference variable of a monitoring and control system operating with electrical means. The monitoring and control system controls both an optical and an acoustical warning signal. Exhaust gas recycling is only carried out at partial engine load and the position of the throttle valve is used as in indication of the load domain.

According to an especially economical feature of the invention, an orifice plate is disposed in the exhaust gas recycle line upstream of the valve and possibly also upstream of a filter. This orifice plate controls an electric differential pressure switch which is closed when no exhaust gas is being recycled and which is disposed in the warning signal circuit.

According to another feature of the invention, an exhaust gas measuring probe, more particularly an oxygen probe, is used to monitor the recycled exhaust gas current.

Other objects, features and advantages of the present invention will be made apparent in the following detailed description of two preferred embodiments thereof which is provided with reference to the accompanying drawing.

BRIEF DESCRIPTION OF THE DRAWING

FIGS. 4, 5 and 6 show the second embodiment of the invention, an enlarged scale view of the probe and a circuit diagram for the electronic control device, respectively.

DESCRIPTION OF THE PREFERRED EMBODIMENTS

Figure 1:
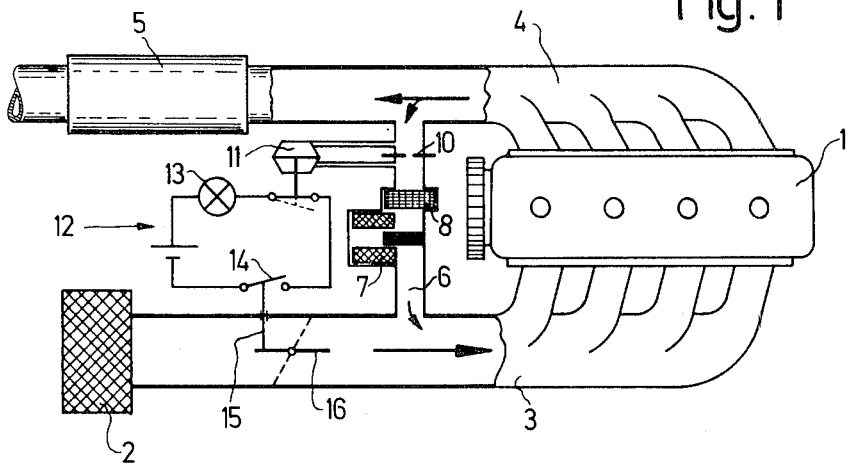
FIGS. 1, 2 and 3 show three variants of a first embodiment of the invention.

Turning now to the drawings, fresh air is supplied to an internal combustion engine through a filter 2 and an induction tube 3. The exhaust gases from the engine are collected in a manifold 4 and released to the atmosphere through a muffler 5 and possibly through catalysts for detoxication of the exhaust gases. The exhaust gas manifold 4 and the induction tube 3 are connected together by means of an exhaust gas recycle line 6 through which a portion of the exhaust gases is returned to the suction side of the engine, particularly when the engine operates in the partial load domain. The flow aperture of the exhaust gas recycle line is controlled by a magnetic valve, and the flow cross-section is either opened to a greater or lesser degree in accordance with the partial load or it is controlled by fully opening or closing of the valve. The magnetic valve 7 is controlled by means which are not described in further detail, for example, by the throttle valve or by an induction tube pressure gauge. A filter 8 is disposed upstream of the magnetic valve 7 in the recycle line 6. This filter 8 is designed to retain small particles of dirt, such a soot, which could cause clogging of the magnetic valve 7.

Figure 2:
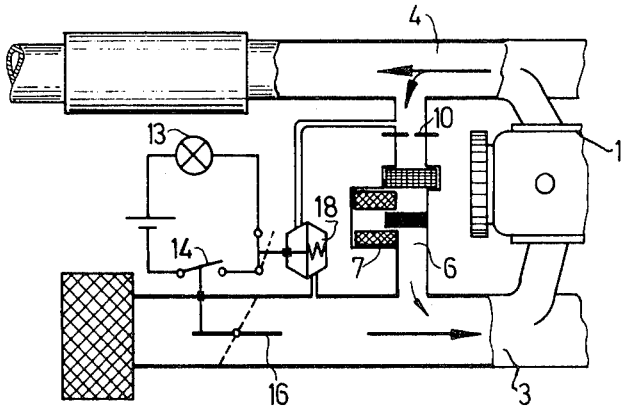
Figure 3:
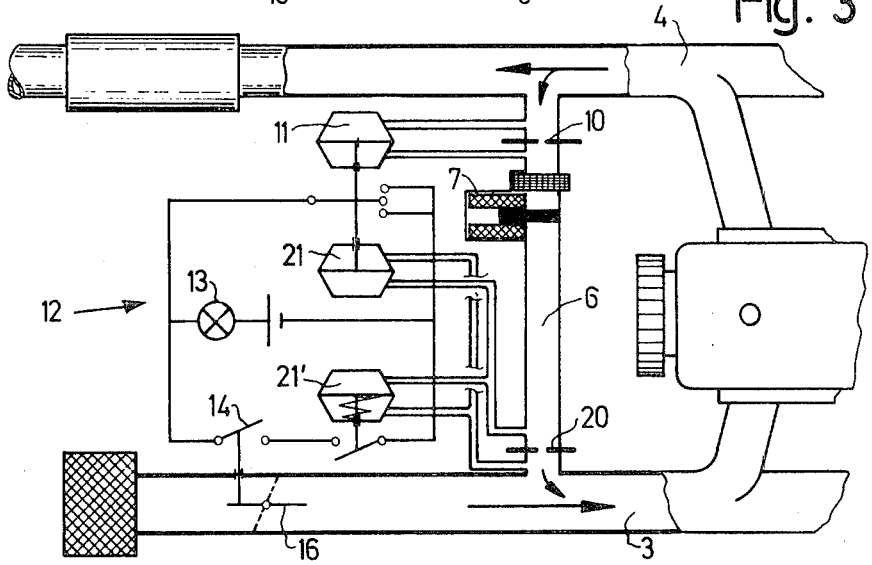

In the embodiment shown in FIGS. 1–3, an orifice plate 10 is disposed upstream of the filter 8 in the exhaust gas recycle line 6. When the gases are flowing, the orifice plate 10 produces a specific pressure drop. The pressure in front of and behind the plate 10 is supplied to a differential pressure switch 11 which is closed as long as there is no flow of gases through the recycle line 6, that is, if there is no pressure difference across the plate 10. The switch 11 forms part of an electrical switching circuit 12 which energizes a signal lamp or an acoustic signaling device 12. Accordingly, the differential pressure switch 11 is open as long as exhaust gases are being recycled and the light 13 is off during this time. The electrical switching circuit contains another switch 14, which is connected in series with the switch 11, i.e., in the sense of a logical "AND". This switch 14 is only open at full engine load, when it interrupts the circuit. The switch 14 is actuated by the throttle valve 16 through an actuating rod 15.

The monitoring system according to the invention operates as follows:

During idling, the magnetic valve 7 is closed and, thus, no recycling of the exhaust gas takes place. The electrical switching circuit 12 is also closed and it is thus possible to confirm the functioning of the light 13 which should be lit and also that of the entire circuit. If the light 13 is not lit up, it is either burned out or else there is a flow of exhaust gas through the orifice plate 10 such as could occur if there is a break in the exhaust recycle line 6 in the section lying between the magnetic valve 7 and the plate 10. For this reason, it is advantageous for the plate 10 to be disposed as close as possible to the beginning of the exhaust gas recycle line 6, i.e., near the exhaust manifold 4. Another reason for the light 13 not being lit up may be that, during idling, the magnetic valve 7 jams and remains open. A break in the recycle line 6 between the magnetic valve and the induction pipe immediately becomes apparent due to the poor performance of the engine, which tends to misfire and may stop running.

In the entire partial load domain, the magnetic valve is open to a greater or lesser extent. A resulting pressure difference occurs across the orifice plate 10, causing the differential pressure switch 11 to be open. Thus, the signal light should normally not be lit. However, if the signal light 13 is on, the exhaust gas recycle line 6 is stopped up which may result from a clogged filter 8 or may be due to jamming of the magnetic valve 7 in its closed position.

At full engine load, the magnetic valve 7 is closed. Thus, exhaust gas flows past the plate 10, and the differential pressure switch 11 is closed. However, in contrast to its state during idling, the switch 14 of the circuit 12 is now open, thus the circuit 12 is interrupted and the lamp 13 cannot be illuminated. A variant of this first embodiment represented in FIG. 2, operates in principle, in the same manner as the variant represented in FIG. 1, except that a differential pressure switch 18 is actuated by the pressure difference between the induction tube 3 or the atmospheric pressure, on the one hand, and the pressure prevailing in front of the orifice plate 10 in the exhaust gas recycle line 6, on the other hand. The effective differential pressure, in this case, is thus substantially higher than that which occurs across the plate 10 (used in the variant according to FIG. 1). The differential pressure switch is then actuated at a specific value of the pressure difference.

In a third variant of the first embodiment, represented in FIG. 3, a second orifice plate 20 is inserted in the recycle line 6 between the magnetic valve 7 and the induction tube 3. The pressure drop across this plate 20 is sensed by the differential pressure switches 21 and 21' which are disposed in the electrical circuit 12. In this variant of the first embodiment of the invention, the exhaust gas recycling system is monitored by comparing the differential pressures at the orifice plates 10 and 20. If the exhaust gas recycling system is functioning correctly when the magnetic valve 7 is open, the exhaust gas flow rate at the beginning of the recycle line 6, that is, at the orifice plate 10, should be identical to the exhaust gas flow rate at the end of the line, that is, through the orifice plate 20. If there is a break in the line or an abnormal stoppage or blockage, the gas flow ceases and this fact is made evident by making a comparative measurement and an absolute measurement with the differential pressure switch 21'. Once again, the lamp 13 is to be illuminated during engine idling or when there is a breakdown in the exhaust recycle system. The switch assembly 11, 21 is connected electrically parallel with the series connection of the switch 21' and the switch 14. As in the case of the other variants, the switch 14 is only open at full engine load and is closed in all other load domains. When there is a flow of exhaust gas and the pipe line 6 is intact, the switch 11, 21 is open, since the same differential pressure should prevail across both orifice plates 10 and 20. This is also the case when there is no gas flow, hence a blockage in the line 6 or an abnormal closure of the magnetic valve 7 causes the closing of the switch 21 and thus of the entire circuit. As in the other variants, the switch 14 is only used to prevent the signal lamp from being illuminated during full load conditions.

In the second embodiment of the invention, represented in FIG. 4, the primary monitoring element is an oxygen probe 24. A simplified view of such a probe is shown in enlarged scale in FIG. 5. It consists of a small tube 25 which is closed at one end and which is made by sintering a solid electrolyte. Platinum layers 26 are vapor-deposited on both sides of the solid electrolyte 25. The two platinum layers 26 are provided with contacts which lead to electrical connecting terminals 27 and 28. The solid electrolyte tube 25 is held in the wall 30 of the exhaust gas pipe 4 by means of a threaded mounting 29. Accordingly, exhaust gas circulates about the platinum layer on the outside of the solid electrolyte 25. On the other hand, the platinum layer on the inside of the little tube is in contact with the gas which is located in the exhaust gas recycle line 6 downstream of the magnetic valve 7. As is apparent from FIG. 4, downstream of the magnetic valve 7, the exhaust gas recycle line 6 is connected to the rear of the probe 24 whence it continues to the induction tube 3. As shown in FIG. 5, the exhaust gas recycle line 6 is clamped to the mounting 29 by means of a hollow screw 31. The solid electrolyte 25 is capable of conducting oxygen ions at the higher temperatures prevailing in the exhaust gas current. Zirconium dioxide has proved especially effective as a solid electrolyte. If the partial pressure of oxygen in the exhaust gas differs from the partial pressure of oxygen in the medium which makes contact with the inside surface of the probe, a potential difference, whose magnitude is a logarithmic function of the quotient of the partial pressures of the oxygen on the two sides of the solid electrolyte 25, is produced between the two terminals 27 and 28. Thus, the output voltage of the oxygen probe changes abruptly when the "air number" $\lambda$ lies near $\lambda = 1.0$. Owing to this abrupt voltage change, the oxygen probe is especially suitable for controlling an operational amplifier such as the one contained in the electronic control device 32, the schematic circuit of which is shown in FIG. 6. The control device 32 contains a simple logical circuit which switches on a warning lamp 13 when the probe voltage exceeds, for example, 25 millivolts and when, at the same time, the exhaust gas is to be recycled, i.e., when the engine is being operated at partial load and not at idling or full load. The signal for the engine load state comes from the throttle valve switch 33 which is actuated by the throttle valve 16. In place of actuation by the throttle valve, the induction tube underpressure may also be used as the actuating means. An air scavenging or flushing valve 34 is disposed in the exhaust gas recycle line 6 at a location upstream of the probe but downstream of the magnetic valve 7, to ensure that, when the magnetic valve 7 is closed, air circulates as rapidly as possible about the inner surface of the solid electrolyte 25 of the probe 24. This scavenging valve 34 opens whenever underpressure (vacuum) peaks occur so that, when the magnetic valve 7 is closed, fresh air is rapidly admitted to the appropriate region of the exhaust gas recycle line. The presence of this fresh air results in the potential difference between the terminals 27 and 28. To ensure that the probe responds rapidly, it is disposed in the exhaust pipe as close as possible to the engine. Thus, the necessary operating temperature, which is in excess of 500° C., is reached very rapidly. However, as soon as exhaust gas again flows through the exhaust gas recycle line and, thus, exhaust gas is present on both sides of the solid electrolyte 25, the potential difference between the terminals 27 and 28 vanishes. The exhaust gas recycling control system does not function if there is a break in the recycle line between the oxygen probe and the induction tube or if the exhaust gas recycle line remains open because the magnetic valve 7 is jammed in the open state. However, in both cases, the engine performance during idling deteriorates to such an extent that a warning signal becomes unnecessary. When used in this simple arrangement, the oxygen probe need not exhibit the above-described steep voltage jump and it is thus possible to use less expensive probes for this monitoring operation.

In the circuit diagram shown in FIG. 6, the oxygen probe 24 is connected to the non-inverting input of a first operational amplifier 36. The first operational amplifier 36 contains an amplifier 37, the output of which is connected, on the one hand, through a feedback resistor 38 to the non-inverting input of the operational amplifier 37 and, on the other hand, to the switch 33 actuated by the throttle valve 16. The inverting input of the amplifier 37 is connected to the tapping point of a voltage divider which consists of the two resistors 39 and 40, connected in series between the positive and negative supply lines.

The position I of the switch 83, as shown in the circuit diagram, corresponds to the partial engine load region and position II corresponds to the full load and idling regions. In FIG. 4, the positions II are the shown position of the switch as well as the lowest position occupied when the throttle valve 16 is essentially closed. Position I corresponds to the intermediate region including the entire partial load range. A second operational amplifier 41, and a third operational amplifier 42, are connected as shown to the outputs I and II of the switch 33, respectively. In both operational amplifiers 41 and 42, the active component is again an amplifier 43 and 44, respectively, and, in each case, their outputs are connected to their non-inverting inputs through a resistor 45. The operational amplifiers 41 and 42 are matched by means of the trimmers 46. Decoupling diodes 47 at the outputs of the amplifiers 43 and 44 permit the passage of whichever voltage passed through the 25 millivolt level coming either from a higher or lower level. A transistor 48 then switches on the lamp 13. This differentiation between a probe voltage in excess of 25 millivolts or lower than 25 millivolts is achieved in that the output I of the switch 33 is connected to the non-inverting input of the amplifier 43, and, in the case of the switching position II, to the inverting input of the amplifier 44. In this way, the lamp is illuminated whenever the probe voltage is in excess of 25 millivolts during partial load operation, i.e., when exhaust gas flows on both sides of the solid electrolyte 25 and it is also illuminated whenever the probe voltage falls below 25 millivolts during idling or full load operation, i.e., when fresh air flows on the inner surface of the solid electrolyte 25. If the light is extinguished during partial load operation, then either the lamp is burned out or the exhaust gas recycle system is not operating correctly. On the other hand, if the light is extinguished during idling or full load operation, then either the lamp is faulty or the oxygen probe or the magnetic valve 7 is not operating correctly.

What is claimed is:

1. An apparatus for exhaust gas detoxication in an internal combustion engine which includes an induction tube, a throttle valve disposed therein and an exhaust manifold, comprising:

(A) an exhaust gas recycle line, connected to establish flow communication between the exhaust manifold and the induction tube of the engine;

(B) valve means, disposed within said recycle line for controlling the gas flow therethrough;

(C) sensor means, disposed within the exhaust manifold for generating signals related to gas conditions; and (D) warning signal means, influenced by said sensor means for producing a warning signal, capable of being sensed and related to the gas flow in said recycle line.

2. An apparatus as defined in claim 1, wherein said sensor means is an oxygen sensor means.

3. An apparatus as defined in claim 1, wherein said sensor means includes a solid electrolyte material structure, having at least two sides, each side thereof provided with an electrical contact, one side being placed in contact with the exhaust gases in the exhaust manifold of the engine and the other side being placed in contact with a reference gas; whereby, should the partial oxygen pressures prevailing on said two sides of said solid electrolyte material structure be different, an electrical potential will appear between said electrical contacts.

4. An apparatus as defined in claim 3, wherein said reference gas is air.

5. An apparatus as defined in claim 3, wherein said solid electrolyte structure is part of a cylinder made from zirconium dioxide, coated with at least one layer of platinum.

6. An apparatus as defined in claim 3, wherein said reference gas is the gas contained in said recycle line downstream of said valve means and wherein said electrical potential is delivered to said warning signal means for the control thereof.

7. An apparatus as defined in claim 6, further comprising:

(E) a flushing valve, connected to said recycle line, downstream of said valve means, for controlling the admission of fresh air to said recycle line.

8. An apparatus as defined in claim 6, further comprising electrical control means which include:

(1) first operational amplifier means for processing said electrical potential from said oxygen sensor means;

(2) second operational amplifier means for processing the output from said first operational amplifier means;

(3) third operational amplifier means for processing the output from said first operational amplifier means;

(4) selector switch means, actuated by means associated with the induction tube and connected to deliver the output signal from said first operational amplifier means to the non-inverting input of said second operational amplifier means and to the inverting input of said third operational amplifier means; and (5) diode means connected in series with the output of said second operational amplifier means and diode means connected in series with the output of said third operational amplifier means, and switch means, controlled by the output from one of said second and third amplifier means, for switching said warning signal means.

* * * * *